US011112167B2

(12) United States Patent
Park et al.

(10) Patent No.: US 11,112,167 B2
(45) Date of Patent: Sep. 7, 2021

(54) REFRIGERATOR

(71) Applicant: SAMSUNG ELECTRONICS CO., LTD., Suwon-si (KR)

(72) Inventors: Hyunnam Park, Suwon-si (KR); Yongman Seo, Suwon-si (KR); Myoungjin Jang, Suwon-si (KR); Jinhong Yu, Suwon-si (KR); Woochul Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/826,726

(22) Filed: Mar. 23, 2020

(65) Prior Publication Data

US 2020/0300537 A1 Sep. 24, 2020

(30) Foreign Application Priority Data

Mar. 21, 2019 (KR) ..... 10-2019-0032610

(51) Int. Cl.

| | |
|---|---|
| ***F25D 25/00*** | (2006.01) |
| ***F25D 25/02*** | (2006.01) |
| ***A47B 88/41*** | (2017.01) |
| ***A47B 88/919*** | (2017.01) |
| ***F25D 23/12*** | (2006.01) |

(52) U.S. Cl.

CPC ..... *F25D 25/025* (2013.01); *A47B 88/41* (2017.01); *A47B 88/919* (2017.01); *F25D 23/12* (2013.01); *A47B 2210/0008* (2013.01); *A47B 2210/0037* (2013.01); *A47B 2210/08* (2013.01)

(58) Field of Classification Search

CPC ..... F25D 23/12; F25D 25/00; F25D 25/021; F25D 25/022; F25D 25/025; A47B 88/41; A47B 88/919

USPC ..... 312/330.1, 401, 404, 270.3

See application file for complete search history.

(56) References Cited

U.S. PATENT DOCUMENTS

| | | | | |
|---|---|---|---|---|
| 4,173,378 A | | 11/1979 | Hanson et al. | |
| 4,662,186 A | | 5/1987 | Park | |
| 5,947,573 A | * | 9/1999 | Tovar | F25D 23/025 312/311 |

(Continued)

FOREIGN PATENT DOCUMENTS

| | | |
|---|---|---|
| CN | 105371560 A | 3/2016 |
| EP | 2333469 | 6/2011 |

(Continued)

OTHER PUBLICATIONS

Extended European Search Report dated Jul. 30, 2020 in European Patent Application No. 20164218.8.

(Continued)

*Primary Examiner* — James O Hansen

(74) *Attorney, Agent, or Firm* — Staas & Halsey LLP

(57) ABSTRACT

A refrigerator having an improved structure to maintain the humidity in a drawer. The refrigerator includes a storage chamber, a drawer configured to be inserted to or withdrawn from the storage chamber, a cover configured to cover an upper part of the drawer, and a rail device configured to guide the drawer to slide in a front-rear direction with respect to the cover and to allow the cover to be located in the storage chamber and to be moved upward with respect to the drawer when the drawer is withdrawn.

17 Claims, 13 Drawing Sheets

(56) References Cited

U.S. PATENT DOCUMENTS

| | | | | |
|---|---|---|---|---|
| 8,226,182 | B2 * | 7/2012 | Park | F25D 25/025 312/404 |
| 2005/0145704 | A1 * | 7/2005 | Hwang | F25D 25/025 236/44 A |
| 2007/0262686 | A1 * | 11/2007 | Ji | A47B 88/00 312/402 |
| 2008/0265733 | A1 * | 10/2008 | Hue | F25D 25/025 312/404 |
| 2016/0040922 | A1 * | 2/2016 | Ha | F25D 23/006 312/404 |

FOREIGN PATENT DOCUMENTS

| | | |
|---|---|---|
| EP | 2982919 | 2/2016 |
| JP | 2004-309016 | 11/2004 |
| KR | 20-0162304 | 12/1999 |
| KR | 10-2004-0063459 | 7/2004 |
| KR | 10-2010-0134962 | 12/2010 |
| KR | 10-2010-0134962 A | 12/2010 |
| KR | 10-1132515 | 4/2012 |
| WO | 2009/125922 | 10/2009 |

OTHER PUBLICATIONS

Chinese Office Action dated Jul. 2, 2021 in Chinese Patent Application No. 202010189853X.

* cited by examiner

REFRIGERATOR

CROSS-REFERENCE TO RELATED APPLICATION(S)

This application is based on and claims priority under 35 U.S.C. § 119 to Korean Patent Application No. 10-2019-0032610, filed on Mar. 21, 2019, in the Korean Intellectual Property Office, the disclosure of which is incorporated by reference herein in its entirety.

BACKGROUND

1. Field

The disclosure relates to a refrigerator, and more particularly, to a refrigerator having an improved structure to maintain the humidity in a drawer.

2. Description of Related Art

A refrigerator is a home appliance including a storage compartment for storing food and a cold air supply device for supplying cold air to the storage compartment in order to keep the food in a fresh state.

Refrigerators may be classified into several types depending on the type of the storage compartment and the door.

Specifically, refrigerators may be classified into a top mounted freezer (TMP) type refrigerator in which a freezing chamber is formed at an upper side thereof and a refrigerating chamber is formed at a lower side thereof by vertically partitioning a storage compartment using a horizontal partition wall, and a bottom mounted freezer (BMF) type refrigerator in which a refrigerating chamber is formed at an upper side thereof and a freezing chamber is formed at a lower side thereof by vertically partitioning a storage compartment using a horizontal partition wall.

In addition, there are a side by side (SMS) type refrigerator in which a freezing chamber is formed at one side thereof and a refrigerating chamber is formed at the other side thereof by horizontally partitioning a storage compartment using a vertical partition wall, and a French door refrigerator (FDR) in which a refrigerating chamber is formed at an upper side thereof and a freezing chamber is formed at a lower side thereof by vertically partitioning a storage compartment using a horizontal partition wall and the refrigerating chamber formed at the upper side is opened and closed by a pair of doors. Further, refrigerators may be classified into a two-door refrigerator, a three-door refrigerator, and a four-door refrigerator according to the number of doors.

A drawer for storing food may be installed in the storage compartment of the refrigerator to be withdrawn from the storage compartment.

In general, when food is to be kept fresh, an improvement in the sealing ability of the drawer is required to maintain adequate humidity. When the drawer does not maintain adequate humidity, the food inside the drawer may dehydrate and the freshness of the food may be lowered.

In addition, the smell of food stored in the storage compartment and the smell of food stored in the drawer may be mixed to lose native flavors of the foods.

SUMMARY

It is an aspect of the disclosure to provide a refrigerator having an improved construction to maintain the humidity in a drawer.

It is another aspect of the disclosure to provide a refrigerator capable of improving usability of a drawer by allowing the drawer to be used without a separate cover opening/closing manipulation.

It is another aspect of the disclosure to provide a refrigerator capable of improving water collecting performance by improving a water collecting pattern of a drawer cover.

Additional aspects of the disclosure will be set forth in part in the description which follows and, in part, will be obvious from the description, or may be learned by practice of the disclosure.

In accordance with an aspect of the disclosure, a refrigerator includes a main body having a storage chamber formed therein, a drawer configured to be inserted to or withdrawn from the storage chamber, a cover configured to cover an upper part of the drawer, and a rail device configured to guide the drawer to slide in a front-rear direction with respect to the cover and to allow the cover to be located in the storage chamber and to be moved upward with respect to the drawer when the drawer is withdrawn.

The rail device may include a first roller provided in a front of the cover, a second roller provided in a rear of the drawer, a first rail provided on the drawer in the front-rear direction to support the movement of the first roller, and a second rail provided on the cover in the front-rear direction to support movement of the second roller.

The first roller may be rotatably disposed in a front of the storage chamber and configured to be movable in an up-down direction along the first rail.

The first rail may include a first section having a first inclination and a second section extending in a horizontal direction from one end of the first section.

The second roller may be rotatably disposed in the rear of the drawer and configured to be movable in the front-rear direction along the second rail.

The second rail may be provided on a rear surface of the cover to extend in the front-rear direction of the storage chamber.

The second rail may include a third section having a second inclination and a fourth section extending in the horizontal direction from one end of the third section.

The first inclination and the second inclination may be identically formed.

A length of the first section and is same as a length of the third section.

The rail device may linearly move the cover in the up-down direction in the first section and the third section.

The rail device may maintain a position in which the cover is moved upward, in the second section and the fourth section.

A water collecting pattern configured to condense moisture may be formed on one surface of the cover corresponding to the drawer.

The refrigerator may further include a cover fixing protrusion configured to limit movement of the cover, wherein a cover support groove corresponding to the cover fixing protrusion may be provided on the storage chamber, and the cover support groove is formed such that the cover is movable in the up-down direction.

The refrigerator may further include a sealing member provided between the drawer and the cover to seal the cover with the drawer.

In accordance with another aspect of the disclosure, a refrigerator includes a storage chamber having an open front surface, a drawer provided inside the storage chamber and configured to be inserted to or withdrawn from the storage chamber, a cover to cover the drawer and having a water collecting pattern formed on at least portion thereof to cover the drawer, and a rail device configured to movably connect the drawer and the cover, wherein the rail device guides the drawer to slidingly move in a first direction of the storage chamber with respect to the cover, and the cover is configured to move in a second direction perpendicular to the first direction with respect to the drawer.

The rail device may be configured to allow the cover to move from a first position in which the drawer is covered to a second position higher than the first position when the drawer is withdrawn.

The rail device may include a first roller rotatably provided on the cover, a second roller rotatably provided on the drawer, a first rail provided on the drawer to support movement of the first roller, and a second rail provided on the cover to support movement of the second roller.

The first rail may include a first section having a first inclination and a second section extending in a horizontal direction from the first section.

The second rail may be provided on a rear surface of the cover to extend in the front-rear direction of the storage chamber and may include a third section having a second inclination and a fourth section extending in the horizontal direction from the third section.

The first inclination and the second inclination may be identically formed.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Configurations shown in the embodiments and the drawings described in the specification are only the preferred embodiments of the disclosure, and thus it is to be understood that various modified examples, which may replace the embodiments and the drawings described in the specification, are possible when filing the application.

Like reference numbers or signs in the various figures of the application represent parts or components that perform substantially the same functions.

The terms used in the specification are used to describe the embodiments of the disclosure. Accordingly, it should be apparent to those skilled in the art that the following description of exemplary embodiments of the disclosure is provided for illustration purpose only and not for the purpose of limiting the disclosure as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that although the terms first, second, etc. may be used herein to describe various components, these components should not be limited by these terms, and the terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

Hereinafter, embodiments of the disclosure will be described in detail with reference to the accompanying drawings.

Figure 1:
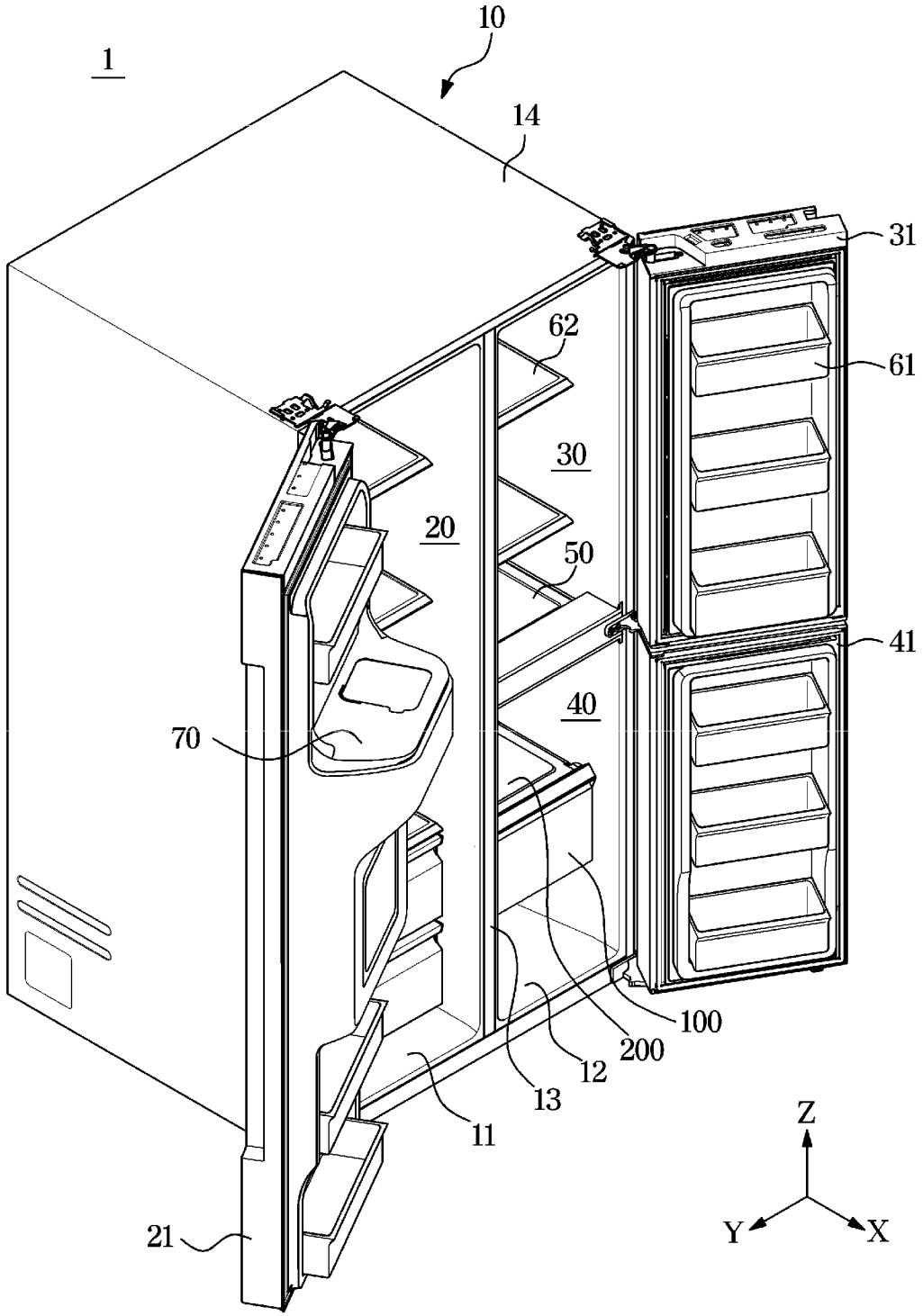
FIG. 1 is a perspective view of a refrigerator according to an embodiment of the disclosure.
Figure 2:
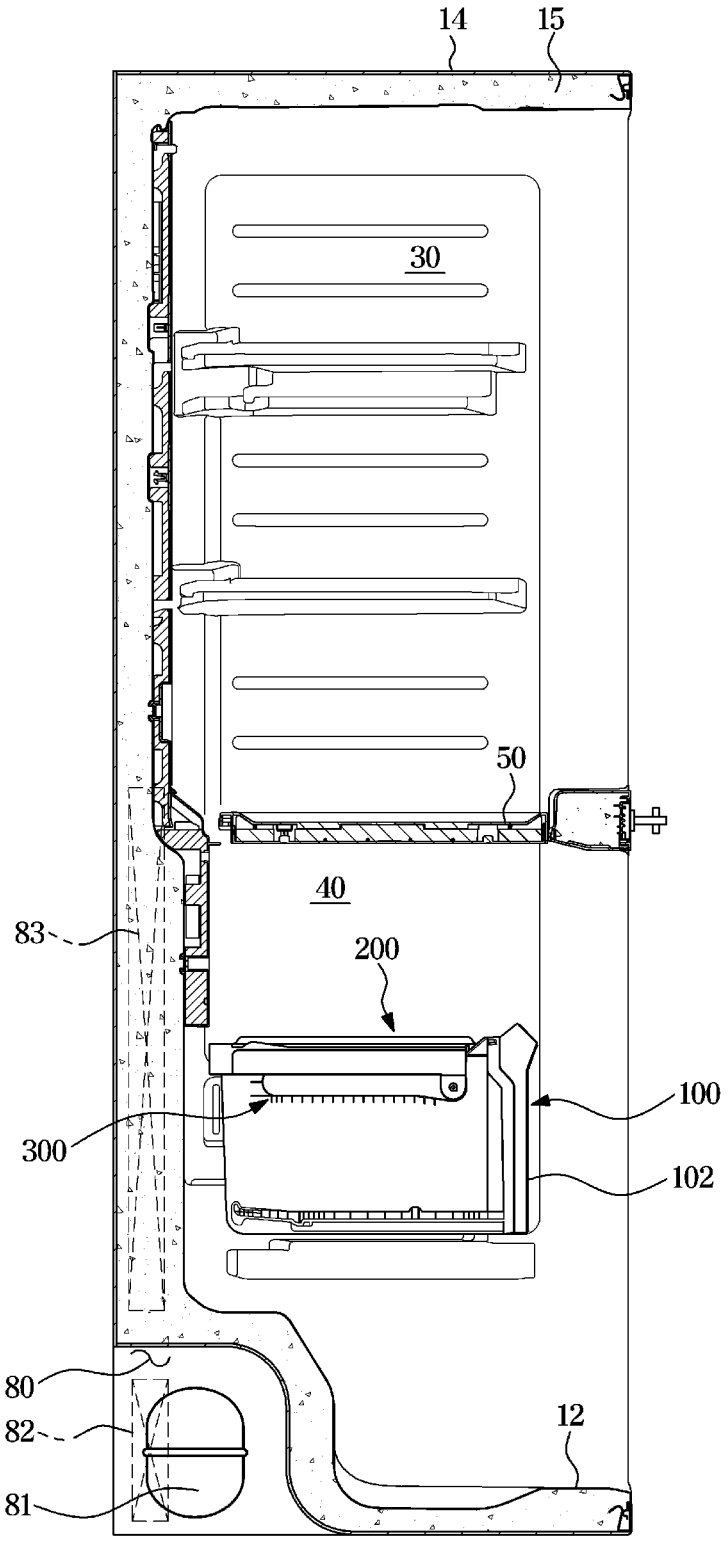
FIG. 2 is a cross-sectional view of the refrigerator according to an embodiment of the disclosure.
Figure 3:
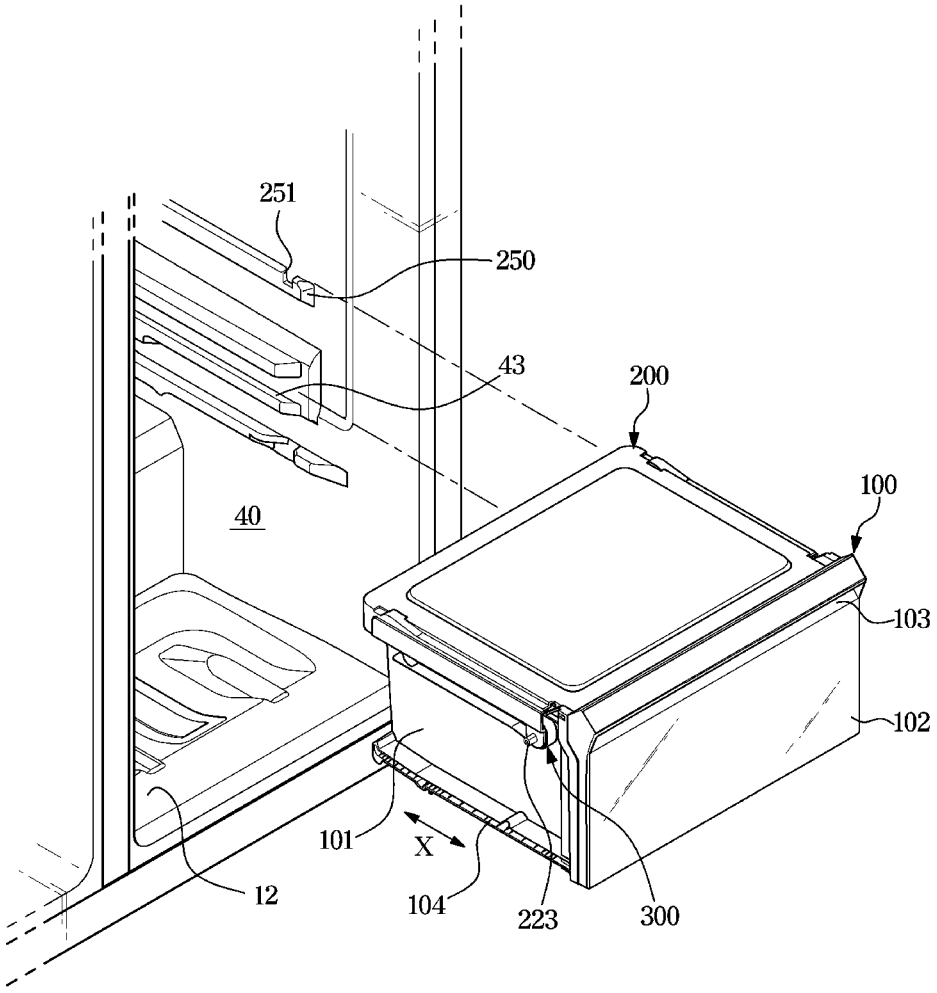
FIG. 3 is a perspective view of a drawer installed in a refrigerating chamber of the refrigerator according to an embodiment of the disclosure.
Figure 4:
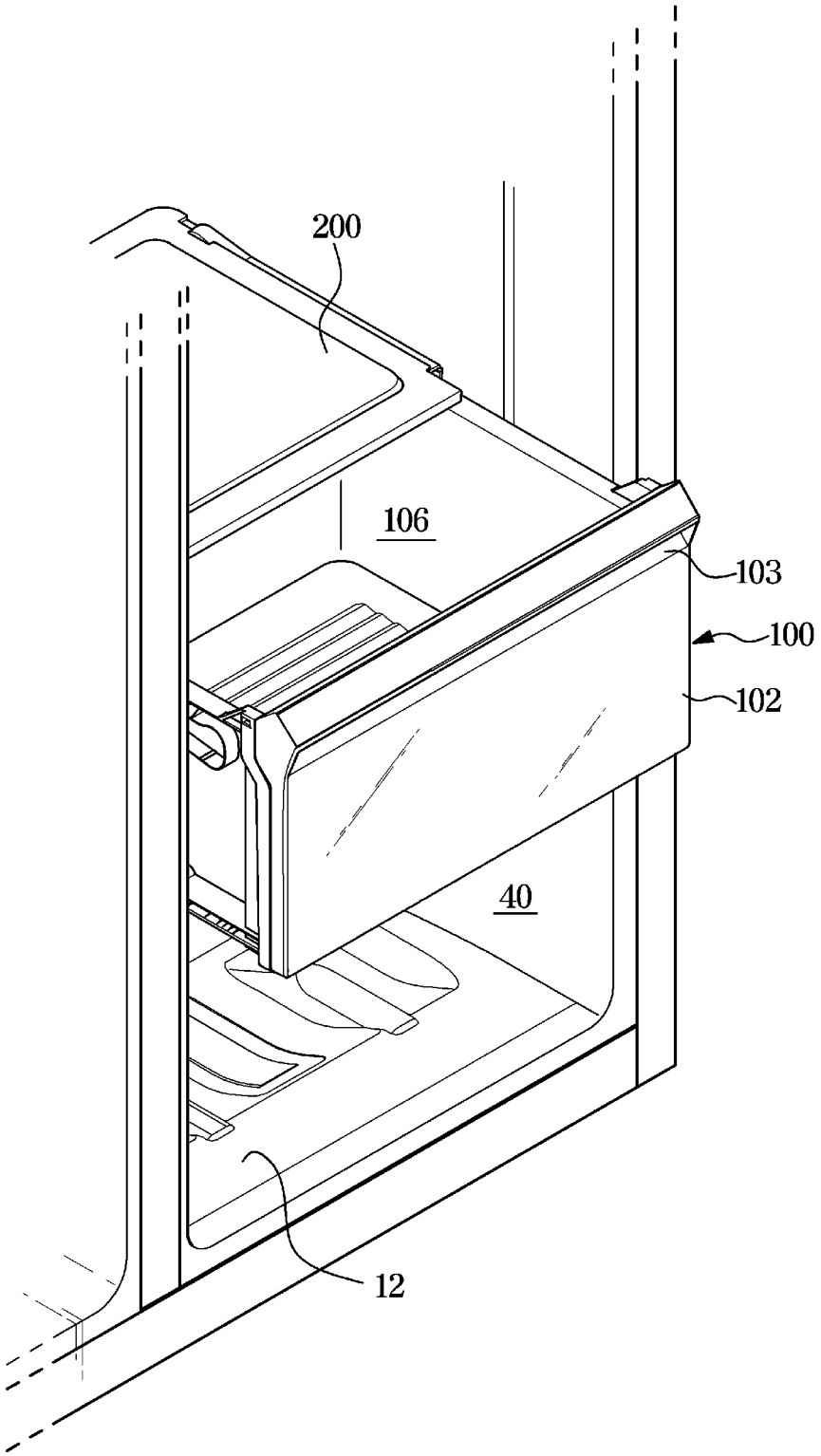
FIG. 4 illustrates a state in which the drawer according to an embodiment of the disclosure is moved.

FIG. 1 is a perspective view of a refrigerator according to an embodiment of the disclosure, FIG. 2 is a cross-sectional view of the refrigerator according to an embodiment of the disclosure, FIG. 3 is a perspective view of a drawer installed in a refrigerating chamber of the refrigerator according to an embodiment of the disclosure, and FIG. 4 illustrates a state in which the drawer according to an embodiment of the disclosure is moved.

As illustrated in FIGS. 1 to 4, a refrigerator 1 may include a main body 10, a plurality of storage chambers 20, 30, and 40 formed inside the main body 10, a plurality of doors 21, 31, and 41 configured to open and close the plurality of storage chambers 20, 30, and 40.

The main body 10 may include a plurality of inner cases 11 and 12 and an outer case 14 disposed outside the plurality of inner cases to form an outer appearance of the refrigerator 1. An insulator 15 may be foamed and filled between the plurality of inner cases 11 and 12 and the outer case 14 to prevent cold air in the plurality of storage chambers 20, 30, and 40 from leaking out of the refrigerator 1.

The plurality of inner cases 11 and 12 may include the first inner case 11 and the second inner case 12 adjacent to each other in a left-right direction Y of the refrigerator 1. The first inner case 11 is disposed on the left side of a partition 13 in the left-right direction Y of the refrigerator 1, and the second inner case 12 is disposed on the right side of the partition 13 in the left-right direction Y of the refrigerator 1. An insulator (not shown) may be foamed and filled between the first inner case 11 and the second inner case 12 to prevent heat exchange between the freezing chamber 20 and the plurality of refrigerating chambers 30 and 40.

The plurality of storage chambers 20, 30, and 40 may include the freezing chamber 20 provided inside the main body 10. The plurality of storage chambers 20, 30, and 40 may include the freezing chamber 20 provided inside the first inner case 11.

The plurality of storage chambers 20, 30, 40 may further include the plurality of refrigerating chambers 30 and 40 provided inside the main body 10 to be adjacent to the freezing chamber 20 in the left-right direction Y of the refrigerator 1. Specifically, the plurality of storage chambers 20, 30, and 40 may further include the plurality of refrigerating chambers 30 and 40 provided inside the second inner case 12. The plurality of refrigerating chambers 30 and 40 may include the first refrigerating chamber 30 and the second refrigerating chamber 40. The first refrigerating chamber 30 and the second refrigerating chamber 40 may be disposed adjacent to each other in an up-down direction Z of the refrigerator. The first refrigerating chamber 30 and the second refrigerating chamber 40 may be partitioned in the up-down direction Z of the refrigerator 1 by a divider 50 to be in communication with each other. Specifically, the first refrigerating chamber 30 may be disposed above the divider 50 in the up-down direction Z of the refrigerator 1, and the second refrigerating chamber 40 may be disposed below the divider 50 in the up-down direction Z of the refrigerator 1.

The plurality of storage chambers 20, 30, and 40 may include an open front surface. A plurality of shelves 62 and a plurality of drawers 100 may be provided in the storage chambers 20, 30, and 40 to store food and the like.

A plurality of doors 21, 31, and 41 may be rotatably installed on the main body 10 to open and close the open front surfaces of the plurality of storage chambers 20, 30, and 40. The plurality of doors 21, 31, and 41 may include the freezing chamber door 21 installed rotatably on the main body 10 to open and close the freezing chamber 20, the first refrigerating chamber door 31 installed rotatably on the main body 10 to open and close the first refrigerating chamber 30, and the second refrigerating chamber door 41 installed rotatably on the main body 10 to open and close the second refrigerating chamber 40.

A plurality of door guards 61 may be provided on rear surfaces of the plurality of doors 21, 31, and 41 to accommodate food and the like.

The plurality of doors 21, 31, and 41 may be provided with a dispenser 70 so that a user may take out water or ice from the outside. Specifically, the dispenser 70 may be provided on the freezing chamber doors 21, 31, and 41.

The refrigerator 1 may further include a cold air supply device configured to supply cold air to the plurality of inner cases 11 and 12. The cold air supply device may include a compressor 81, a condenser 82, an expansion valve (not shown), and an evaporator 83. The compressor 81 for compressing a refrigerant and the condenser 82 for condensing the compressed refrigerant may be installed in a machine room 80 provided at a lower side of the rear of the plurality of storage chambers 20, 30, and 40. As an example, the compressor 81 may be installed in the machine room 80 to be positioned at the lower side of the rear of the plurality of refrigerating chambers 30 and 40, and the condenser 82 may be installed in the machine room 80 to be positioned at the lower side of the rear of the freezing chamber 20.

The plurality of drawers (hereinafter, referred to as drawers) provided in the plurality of storage chambers 20, 30, and 40 is provided to accommodate and store food therein. Although the embodiment of the disclosure illustrates as an example that two of the drawers are provided, the disclosure is not limited thereto. For example, a plurality of drawers may be provided depending on the capacity of the storage chambers.

The drawer 100 provided in the second refrigerating chamber 40 is configured such that vegetables and fruits may be stored therein. The drawer 100 may be configured to store foods in which moisture easily evaporates, such as vegetables and fruits. The drawer 100 may include a cover 200 to cover an upper portion of the drawer 100 so that the food therein does not directly contact cold air. The drawer 100 may be opened and closed by the cover 200. The drawer 100 is sealed by the cover 200 such that cold air is not introduced from the outside. The drawer 100 and the cover 200 are configured to be movable by a rail device 300, which will be described later.

The drawer 100 may be configured to be movable in a front-rear direction X of the refrigerator 1. The front-rear direction X of the refrigerator 1 is referred to as a first direction X. The first direction X refers to the front-rear direction X of the storage chambers 20, 30, and 40 of the refrigerator 1. The drawer 100 is configured to be movable in the first direction X of the refrigerator 1. The drawer 100 may slide in the first direction X from the storage chambers 20, 30, and 40.

The drawer 100 may be configured to be put in and out in the front-rear direction X of the refrigerator 1. Specifically, the drawer 100 may be provided inside the storage chambers 20, 30, and 40 to be withdrawn toward the front of the storage chambers 20, 30, and 40.

The drawer 100 may have a storage space 106 to accommodate food therein. The drawer 100 may include a case 101 forming an outer appearance. The storage space 106 may be provided inside the case 101.

At least one surface of the case 101 may be opened. Specifically, an upper surface of the case 101 may be opened.

The case 101 of the drawer 100 may include a front panel 102 forming an exterior front surface. The front panel 102 may be provided with a handle 103 such that the user may easily withdraw the drawer 100 from the storage chambers 20, 30, and 40. The handle 103 may be provided on the front panel 102 such that the user may easily grip the handle 103. Specifically, the handle 103 may protrude toward the front of the storage chambers 20, 30, and 40. It is appropriate that the handle 103 is formed on an upper portion of the front panel 102.

At least a portion of the case 101 may be formed of a transparent material such that the user may check the state of food in the storage space 106. The front panel 102 may be formed of a transparent material such that the user may check the state of food in the storage space 106. Although the embodiment of the disclosure illustrates as an example that the case and the front panel are integrally formed, the disclosure is not limited thereto. For example, the case and the front panel may be provided separately and formed by being coupled to each other.

The drawer 100 may be provided with a movement guide 104 such that the user may easily slide the drawer 100 in and out. The movement guide 104 may be formed at lower portions of opposite side surfaces of the drawer 100. The movement guide 104 may be formed at lower portions of opposite side surfaces of the case 101. The movement guide 104 may extend in the front-rear direction X of the drawer 100. The movement guide 104 of the drawer 100 may be movably supported by a guide rail 43 formed on the inner case 12 of the refrigerator 1. The guide rail 43 may be formed in a length and a shape corresponding to the movement guide 104 of the drawer 100. The guide rail 43 may be formed on the inner cases 11 and 12 of the refrigerator 1.

The drawer 100 may be slidingly moved in the front-rear direction X of the storage chambers 20, 30, and 40 by the movement guide 104 coupled with the guide rail 43 formed in the inner cases 11 and 12 of the refrigerator 1.

Figure 5:
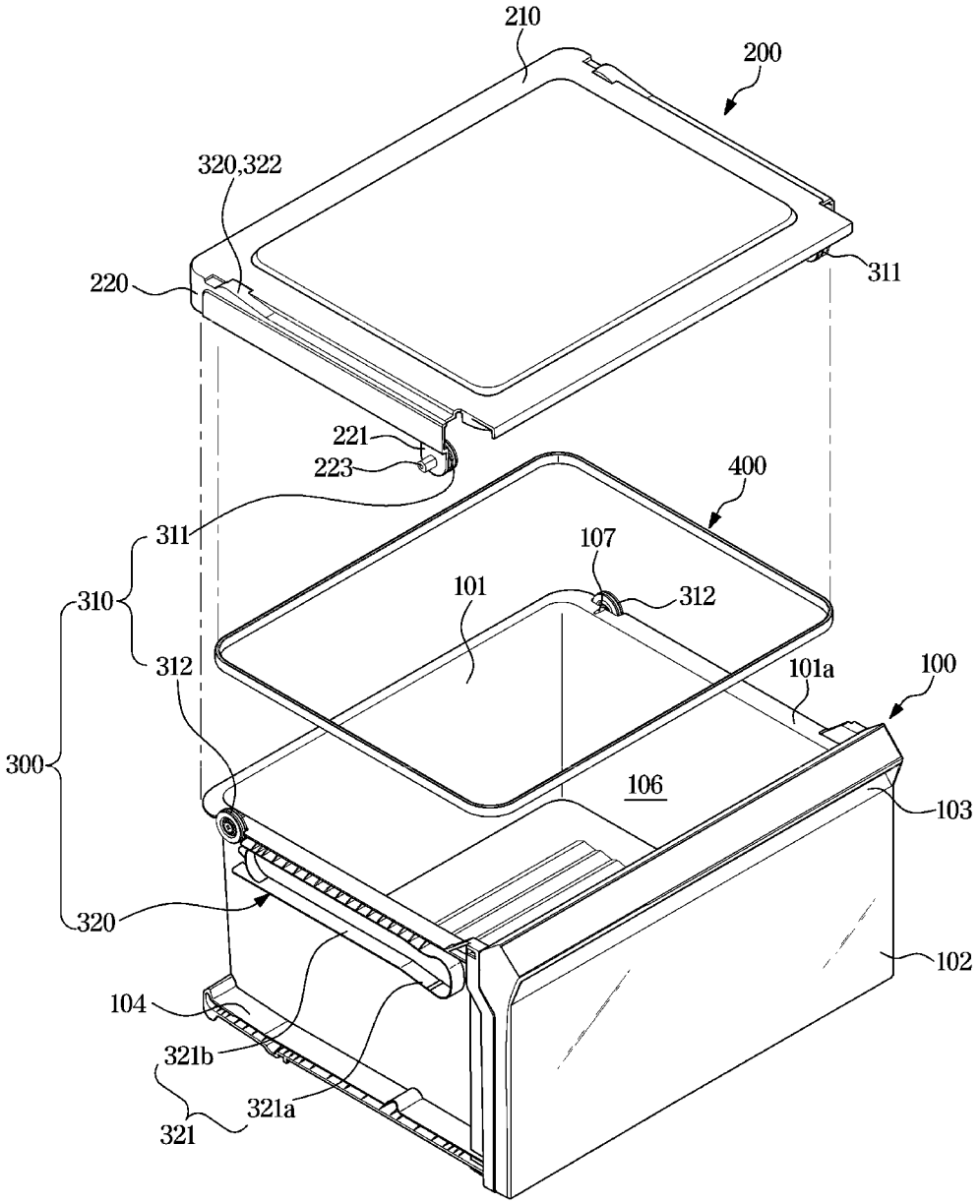
FIG. 5 is an exploded perspective view of the drawer and a cover according to an embodiment of the disclosure.
Figure 6:
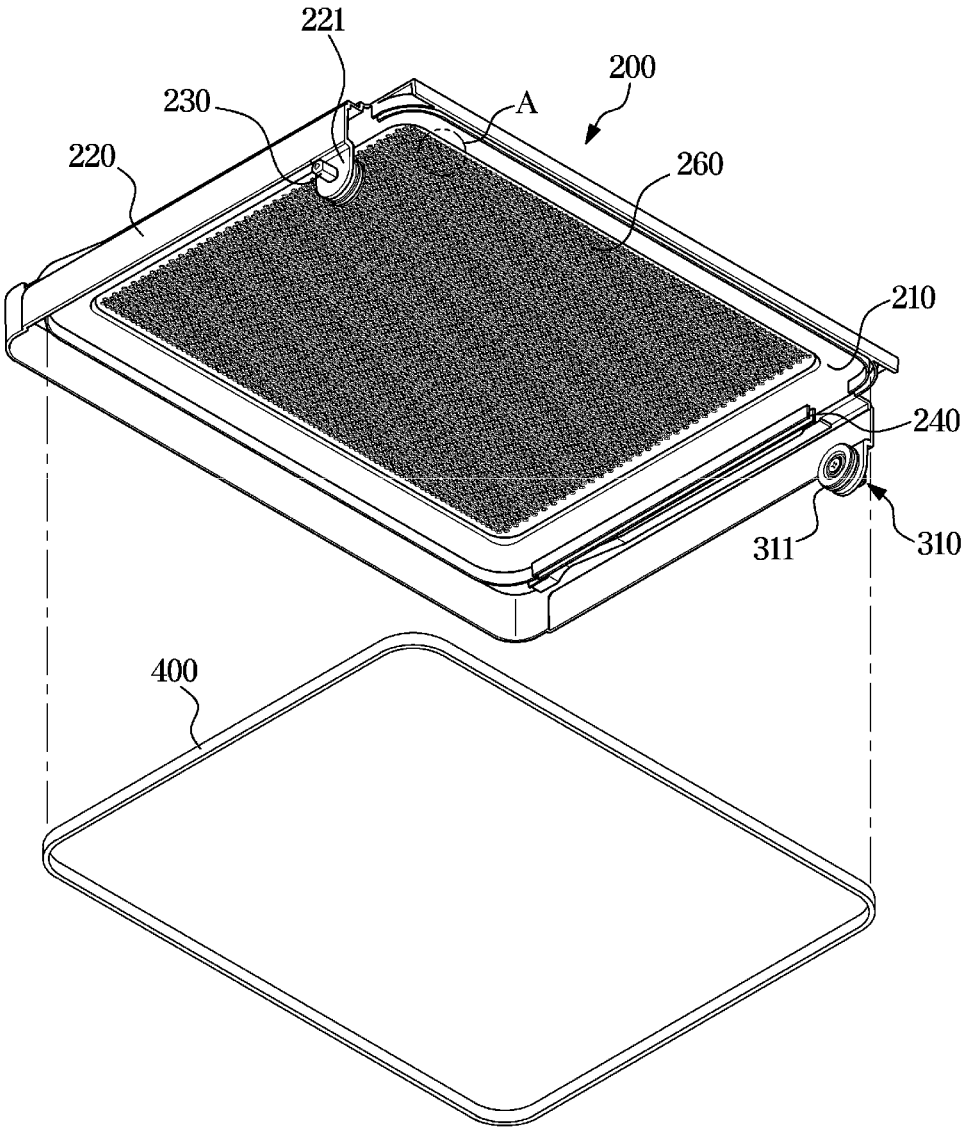
FIG. 6 is a perspective view of the cover and a sealing member to be coupled to the cover according to an embodiment of the disclosure.
Figure 7:
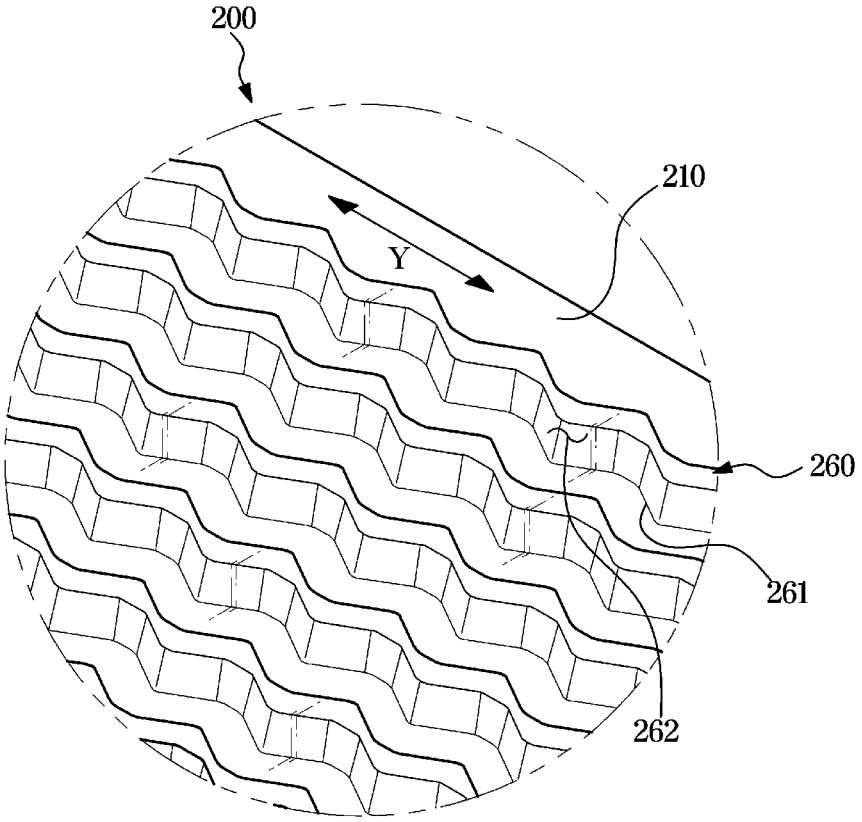
FIG. 7 is an enlarged view of a portion A of FIG. 6, illustrating a water collecting pattern of the cover according to an embodiment of the disclosure.
Figure 8:
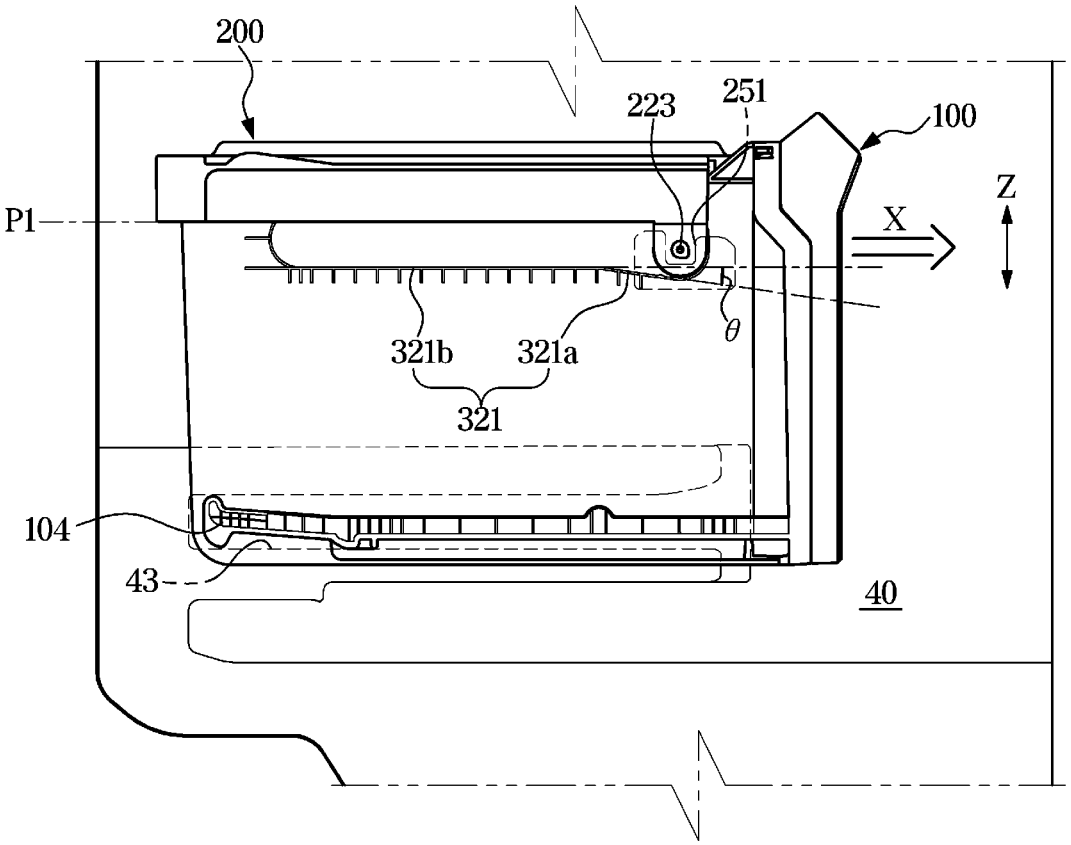
FIG. 8 illustrates a state in which the drawer according to an embodiment of the disclosure is installed in a refrigerating chamber.
Figure 9:
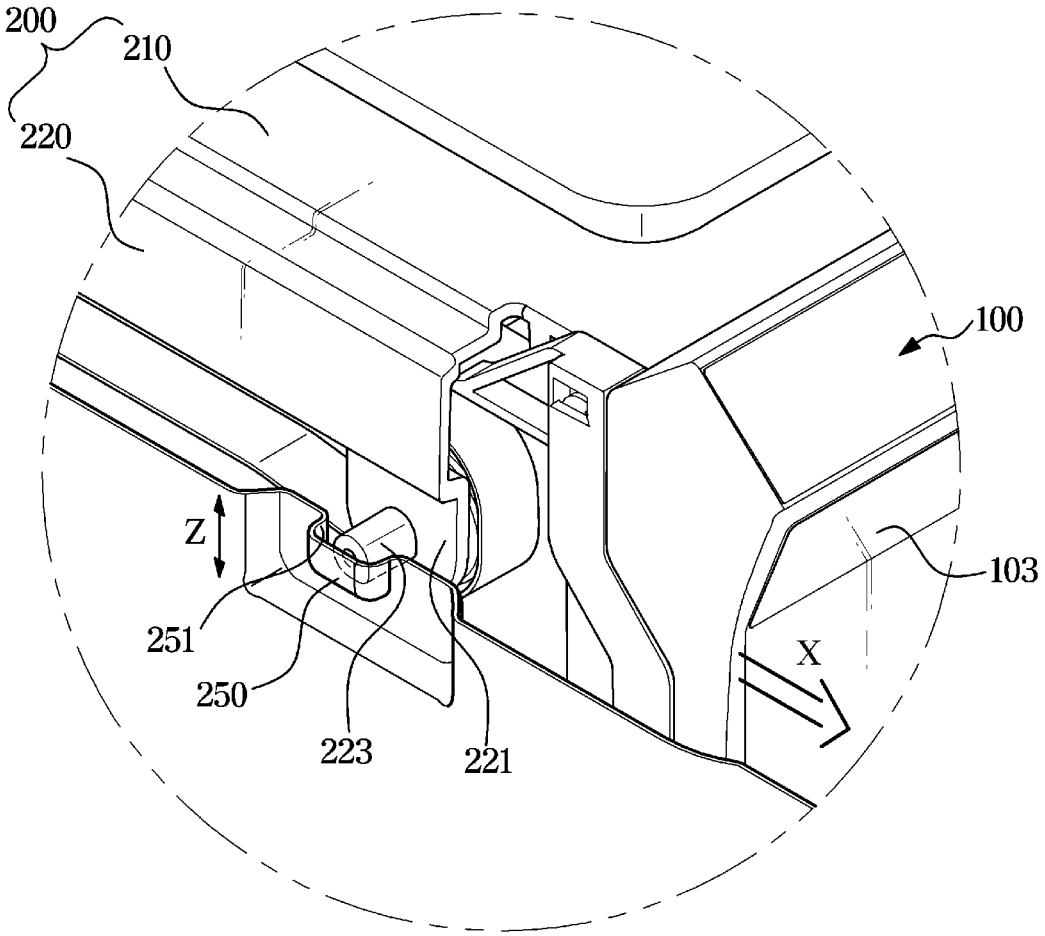
FIG. 9 illustrates a state in which the drawer closed by the cover according to an embodiment of the disclosure is installed in the refrigerating chamber.

FIG. 5 is an exploded perspective view of the drawer and a cover according to an embodiment of the disclosure, FIG. 6 is a perspective view of the cover and a sealing member to be coupled to the cover according to an embodiment of the disclosure, FIG. 7 is an enlarged view of a portion A of FIG. 6, illustrating a water collecting pattern of the cover according to an embodiment of the disclosure, FIG. 8 illustrates a state in which the drawer according to an embodiment of the disclosure is installed in a refrigerating chamber, and FIG. 9 illustrates a state in which the drawer closed by the cover according to an embodiment of the disclosure is installed in the refrigerating chamber.

As illustrated in FIGS. 5 to 9, the drawer 100 may include the case 101 having the open upper surface and the cover 200 configured to cover the open upper surface of the case 101.

The case 101 forming the drawer 100 may have the storage space 106 to accommodate food therein. The storage space 106 may be provided inside the case 101.

At least one surface of the case 101 may be opened. The upper surface of the case 101 may be opened. A portion of the upper surface of the case 101 may form a contact surface 101*a* to be in contact with the cover 200. Specifically, the contact surface 101*a* of the case 101 may be formed at an edge of the open upper surface of the drawer 100. The contact surface 101*a* may be formed to face the cover 200. The contact surface 101*a* of the case 101 may be configured to be in contact with at least a portion of the cover 200 when the cover 200 seals the storage space 106. The cover 200 may be in contact with or in close contact with the contact surface 101*a* of the case 101.

A sealing member 400 to improve the sealing ability may further be provided at a gap between the drawer 100 and the cover 200. The sealing member 400 is configured to be in contact with or in close contact with the contact surface 101*a* when sealing the storage space 106 of the drawer 100.

The cover 200 may be formed to correspond to the upper opening of the case 101 of the drawer 100. The cover 200 may be configured to cover the upper portion of the drawer 100. The cover 200 may be configured to selectively open and close the storage space 106 of the drawer 100. Specifically, the cover 200 may move in the up-down direction Z along the rail device 300. The up-down direction Z of the refrigerator 1 refers to the second direction Z. The cover 200 may move in the second direction Z by the rail device 300. The cover 200 may be coupled to the open upper surface of the case 101 to move in the up-down direction Z of the drawer 100 by the rail device 300.

The cover 200 may include a cover panel 210 forming an outer appearance and a cover frame 220. The cover panel 210 may be formed in a size corresponding to cover the open upper surface of the case 101. The cover panel 210 may be formed to correspond to the storage space 106 of the case 101 or may be formed larger than the storage space 106.

The cover frame 220 may extend from an edge of the cover panel 210. The cover frame 220 may extend downward from the edge of the cover panel 210. Specifically, the cover frame 220 may extend downward from at least one end of the cover panel 210. The cover frames 220 may extend downward from opposite sides and rear ends of the cover panel 210. The cover frames 220 may extend from three surfaces except for a front surface of the cover panel 210.

The cover frame 220 may be provided with at least a portion of the rail device 300, which will be described later. Detailed description of the rail device 300 will be described later.

The drawer 100 may accommodate or store fruits or vegetables having a high moisture content. In order to maintain the freshness of fruits or vegetables, it is important to maintain the humidity of the storage space 106. The drawer 100 may be sealed by the cover 200 to maintain the humidity of the storage space 106. The sealing member 400 is configured to improve the sealing ability of the storage space 106 of the drawer 100. The sealing member 400 may be provided between the drawer 100 and the cover 200. The sealing member 400 may be coupled to the cover 200. Specifically, the sealing member 400 may be coupled to a sealing member coupling portion 240 provided on a rear surface of the cover panel 210. The sealing member 400 may be formed of an elastic material. The sealing member 400 may include rubber and silicon material. The sealing member 400 may be formed in a square ring shape. The sealing member 400 may be formed to correspond to the contact surface 101*a* of the case 101 of the drawer 100. At least one surface of the sealing member 400 may correspond to the contact surface 101*a* of the case 101 to be in contact with or in close contact with the contact surface 101*a*.

Although the embodiment of the disclosure illustrates as an example that the sealing member is disposed between the cover and the drawer, the disclosure is not limited thereto.

A water collecting pattern 260 may be formed on the rear surface of the cover panel 210 in order to condense moisture. The water collecting pattern 260 may be formed on one surface of the cover panel 210 facing the storage space 106 of the drawer 100. The water collecting pattern 260 may be formed on the rear surface of the cover panel 210. Specifically, when the storage space 106 of the drawer 100 has a sealed structure, water droplets may form on the cover 200. That is, water droplets may form on the cover 200 due to dew condensation. As the size of the water droplets formed on the cover 200 increases, the water droplets may fall into the storage space 106 of the drawer 100 by gravity. In this case, the vegetables or fruits stored in the storage space 106 of the drawer 100 may be damaged by the falling water droplets. As such, the water collecting pattern 260 may be formed on the cover 200 to prevent food damage caused by water droplets formed on the cover 200.

The water collecting pattern 260 of the cover 200 may extend in the left-right direction Y of the storage chamber 40. The water collecting pattern 260 may extend in the left-right direction Y of the cover 200. The water collecting pattern 260 may have a shape recessed upward on a rear surface of the cover 200. The water collecting pattern 260 may include a plurality of water collecting portions 261. The water collecting portion 261 may be disposed to be spaced apart from each other. The water collecting portion 261 may be formed to communicate with each other by being connected to each other. That is, the plurality of water collecting portions 261 may prevent the collected water (droplets) from agglomerating with each other.

The water collecting portion 261 may include a hexahedron shape. A plurality of hexahedral water collecting portions 261 may be disposed to be spaced apart from each other and may be connected to each other. The plurality of water collecting portions 261 may form a water collecting space 262 by being connected to each other. The water collecting space 262 formed by the plurality of water collecting portions 261 may be configured to increase the amount of water collected by increasing the contact area or surface tension with water (droplets). The water collecting space 262 may extend in the left-right direction Y of the cover 200 to prevent the water (droplets) from agglomerating with each other. Although the embodiment of the disclosure illustrates as an example that the water collecting portion is formed in a hexahedral shape, the disclosure is not limited thereto. For example, the water collecting portion may include a columnar shape having a polygonal or circular cross section.

The refrigerator 1 may further include the rail device 300 allow the drawer 100 to slide in the front-rear direction (first direction X) of the refrigerator 1 with respect to the cover 200 and to allow the cover 200 to move in the up-down direction (second direction Z) with respect to the drawer 100.

The rail device 300 may include a roller 310 and a rail 320. The roller 310 may include a first roller 311 provided on the cover 200 and a second roller 312 provided on the drawer 100. The rail 320 may include a first rail 321 provided on the drawer 100 and a second rail 322 provided on the cover 200.

The rail device 300 may include the first roller 311 provided on the cover 200, the second roller 312 provided on the drawer 100, the first rail 321 provided on the drawer 100 to support the movement of the first roller 311, and the second rail 322 provided on the cover 200 to support the movement of the second roller 312.

The first roller 311 provided on the cover 200 may be provided on the cover frame 220 of the cover 200. The cover frame 220 may extend from the edge of the cover panel 210. The cover frame 220 may extend downward from the edge of the cover panel 210. The cover roller 220 may be provided with a first roller mounting portion 221 on which the first roller 311 is mounted. Specifically, the first roller mounting portion 221 may extend downward from a front end of the cover frame 220. The first roller mounting portions 221 may be formed at opposite front ends of the cover frame 220. The first roller 311 may be rotatably installed on the first roller mounting portion 221. The first roller 311 may be configured to be movable along the first rail 321 in front of the storage chambers 20, 30, and 40.

The first rail 321 guiding the movement of the first roller 311 may be provided on the drawer 100. Specifically, the first rail 321 may extend toward the first direction X of the storage chambers 20, 30, and 40. The first rails 321 may be provided the opposite side surfaces of the drawer 100 to direct to the first direction X of the storage chambers 20, 30, and 40. The first rails 321 may be provided the opposite outer side surfaces of the drawer 100. The first rail 321 may be integrally formed with the drawer 100. The drawer 100 may be slidingly moved in the first direction X by the first roller 311 rotatably supported on the first rail 321. The first rail 321 may be moved by the rotation of the first roller 311 provided on the cover 200 as the drawer 100 moves.

The first rail 321 may be configured to allow the cover 200 to move in the second direction Z by the first roller 311 moving along the first rail 321. The first rail 321 may include a predetermined step provided such that the cover 200 moving along the first rail 321 may move in the second direction Z. Specifically, the first rail 321 is disposed in the front of the storage chambers 20, 30, and 40, and may include a first section 321*a* having a first inclination 81 and a second section 321*b* extending from the first section 321*a*. The first section 321*a* of the first rail 321 may be provided in the front of the side surface of the drawer 100 to direct to the front of the storage chambers 20, 30, and 40.

The second section 321*b* of the first rail 321 may be provided at the side surface of the drawer 100. The second section 321*b* may extend from the first section 321*a*. The second section 321*b* may extend from a rear end of the first section 321*a*. The second section 321*b* may extend in the parallel direction from the rear end of the first section 321*a*. The second section 321*b* may be positioned above the first section 321*a*.

The first roller 311 of the cover 200 may be coupled to the first rail 321 to move in the first direction X which is the front-rear direction. The first roller 311 of the cover 200 moves from a first position P1 when in the first section 321*a* of the first rail 321 to a second position P2 when in the second section 321*b* of the first rail 321.

A cover fixing protrusion 223 for fixing the cover 200 to the refrigerating chambers 30 and 40 of the refrigerator 1 may be provided on the first roller mounting portion 221 of the cover 200. The cover fixing protrusion 223 may protrude from an outer surface of the first roller mounting portion 221 of the cover frame 220. The cover fixing protrusion 223 may be formed in a cylindrical shape. Specifically, the cover fixing protrusion 223 may protrude in the first direction X from a front outer side of the cover 200.

A cover support portion 250 on which the cover 200 is mounted may be provided on the inner case of the refrigerating chambers 30 and 40 of the refrigerator 1. The cover support portion 250 is configured to allow the cover 200 to be seated and supported. A cover support groove 251 is formed on the cover support portion 250 to fix the cover 200. The cover support groove 251 may be disposed in the front of the cover support portion 250. The cover support groove 251 may be formed at a position corresponding to the cover fixing protrusion 223 of the cover 200. The cover support groove 251 may have an open upper side to allow the cover 200 to move in the up-down direction Z of the storage chambers 20, 30, and 40. The cover support groove 251 supports the cover 200 such that the cover 200 does not move together when the drawer 100 moves in the first direction X. The cover 200 is movable in the second direction Z by the cover support groove 251 of which the upper side is opened. Although the embodiment of the disclosure illustrates as an example that the cover support portion is formed integrally with the inner case of the storage chamber, the disclosure is not limited thereto. For example, the cover support portion may include a bracket or the like separately installed in the storage chamber.

The first roller 311 of the cover 200 moving along the first rail 321 is in close contact with the drawer 100 when located in the first section 321*a* of the first rail 321 and moves upward from the first position P1 to be positioned at the second position P2 when located in the second section 321*b* of the first rail 321.

The second roller 312 provided on the drawer 100 may be disposed at the case 101 of the drawer 100. The second roller 312 may be disposed in the rear of the drawer 100. The second roller 312 is rotatably installed on an upper side of the rear of the drawer 100. The second roller 312 may be provided at an upper side of the contact surface 101*a* of the case 101. The second roller 312 may be provided at an upper edge of the case 101. The second roller 312 may be rotatably installed on a second roller mounting portion 107 provided on the case 101. The second roller mounting portions 107 may be provided at the left and right sides of the contact surface 101*a* of the case 101. The second roller mounting portion 107 may be formed at rear ends of opposite sides of the contact surface 101*a*. The second roller 312 may be configured to be movable along the second rail 322 in the front-rear direction X of the storage chambers 20, 30, and 40.

The second rail 322 guiding the movement of the second roller 312 may be provided on the cover 200. Specifically, the second rail 322 may be provided at opposite side ends of the rear surface of the cover 200. The second rail 322 may extend to direct to the first direction X of the storage chambers 20, 30, and 40. The second rail 322 may be provided at opposite sides of an inner surface of the cover 200. The second rail 322 may be integrally formed with the cover 200.

The drawer 100 may be slidingly moved in the first direction X by the second roller 312 rotatably supported on the second rail 322. The second roller 312 may slidingly move along the second rail 322 while rotating. The drawer 100 may be slidingly moved in the first direction X along the second rail 322 of the drawer 100 by the rotating second roller 312.

The second rail 322 may be configured to allow the cover 200 to move in the second direction Z by the second roller 312 moving along the second rail 322. The second rail 322 may include a predetermined step to allow the cover 200 to move in the up-down direction Z by the second roller 312 moving along the second rail 322. Specifically, the second rail 322 is disposed in the rear of the storage chambers 20, 30, and 40, and may include a third section 322*a* having a second inclination 82, and a fourth section 322*b* disposed in the front of the storage chambers 20,30, and 40 and extending from the third section 322*a*. The fourth section 322*b* extends from a front end of the third section 322*a*. The fourth section 322*b* may be formed in the horizontal direction. The first section 321*a* of the first rail 321 and the third section 322*a* of the second rail 322 may have the same inclination and length. The second section 321*b* of the first rail 321 and the fourth section 322*b* of the second rail 322 may have the same inclination and length. Accordingly, the drawer 100 and the cover 200 may be stably moved at a regular interval by the first roller 311 moving on the first rail 321 and the second roller 312 moving on the second rail 322.

The first inclination θ1 of the first rail 321 and the second inclination θ2 of the second rail 322 may be identically formed. The first inclination θ1 of the first rail 321 and the second inclination θ2 of the second rail 322 may have the same length. Specifically, the first roller 311 and the second roller 312 moving along the first rail 321 and the second rail 322 may move on the first section 321*a* and the third section 322*a* having the same inclination, respectively, and may move on the second section 321*b* and the fourth section 322*b*, respectively.

The second section 321*b* of the first rail 321 and the fourth section 322*b* of the second rail 322 may be formed to face each other. When the first roller 311 and the second roller 312 move on the second section 321*b* and the fourth section 322*b*, the cover 200 may be spaced apart from the drawer 100 by raising at a predetermined interval.

The second roller 312 of the drawer 100 may be coupled to the second rail 322 of the cover 200 to move in the first direction X which is the front-rear direction. The cover 200 supported by the second roller 312 of the drawer 100 moves from the first position P1 when the second roller 312 is in the third section 322*a* to the second position P2 when the second roller 312 is in the fourth section 322*b*. That is, the cover 200 is located at the first position P1 when the second roller 312 is in the third section 322*a* and at the second position P2 when the second roller 312 is in the fourth section 322*b*.

One side (front) of the cover 200 is supported by the first roller 311 coupled to the first rail 321 and the other side (rear) of the cover 200 is supported by the second roller 312 coupled to the second rail 322, so that the cover 200 may be stably moved by the first roller 311 and the second roller 312.

The cover 200 is positioned at the first position P1 in which the cover 200 comes into contact with the contact surface 101*a* of the drawer 100 when the first roller 311 and the second roller 312 are positioned in the first section 321*a* and the third section 322*a*, respectively. When the drawer 100 is withdrawn, the first roller 311 and the second roller 312 are positioned in the second section 321*b* and the fourth section 322*b*, respectively, and the cover 200 is positioned at a second position P2 higher than the first position P1 by moving upward. The drawer 100 may move in the front-rear direction in a state where the cover 200 is positioned at the second position P2.

As such, the cover 200 moving from the first position P1 to the second position P2 when the drawer 100 is withdrawn may improve the usability of the drawer to improve the quality of the product.

Further, the cover 200 may minimize contact with the sealing member positioned between the drawer 100 and the cover 200 when the drawer 100 is withdrawn, so that the cover 200 may improve the sealing performance of the drawer 100 and at the same time maintain the humidity to improve the storage performance of the drawer 100.

Figure 10:
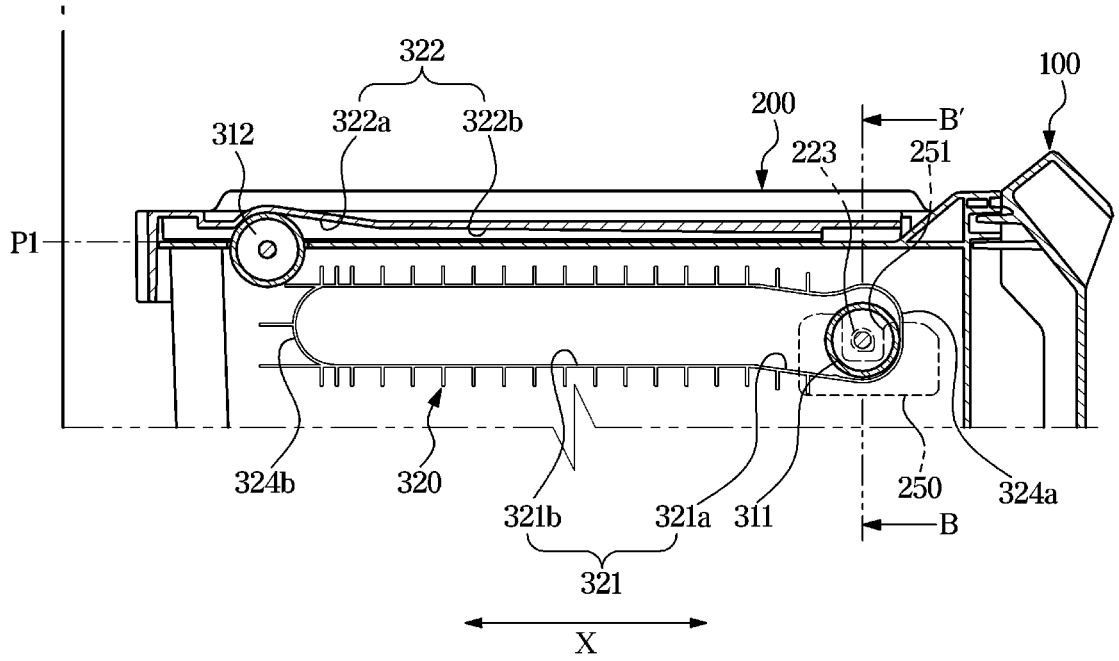
FIG. 10 illustrates a state before a rail device according to an embodiment of the disclosure operates.
Figure 11:
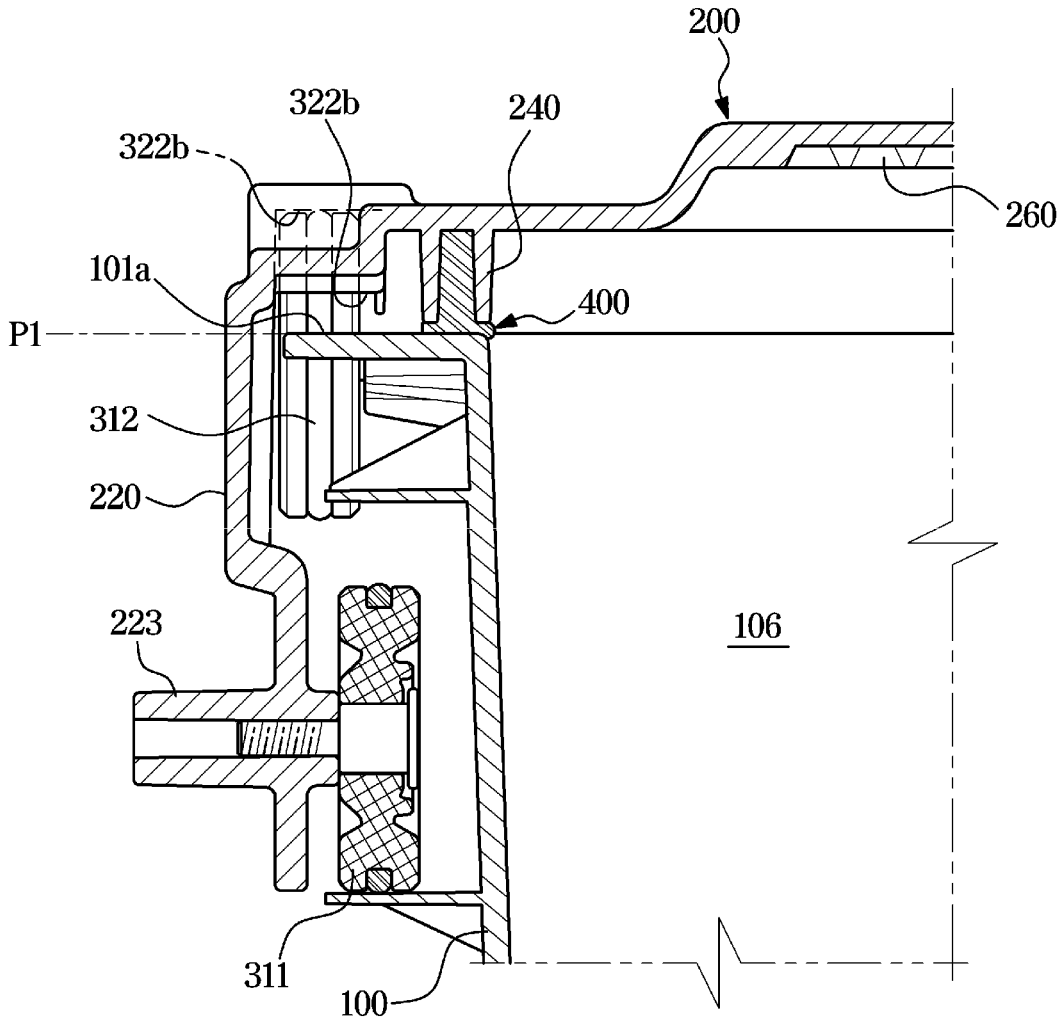
FIG. 11 is a cross-sectional view taken along line B-B' of FIG. 10, illustrating the state of the drawer and cover in a first position in which the drawer and cover are in close contact with each other.
Figure 12:
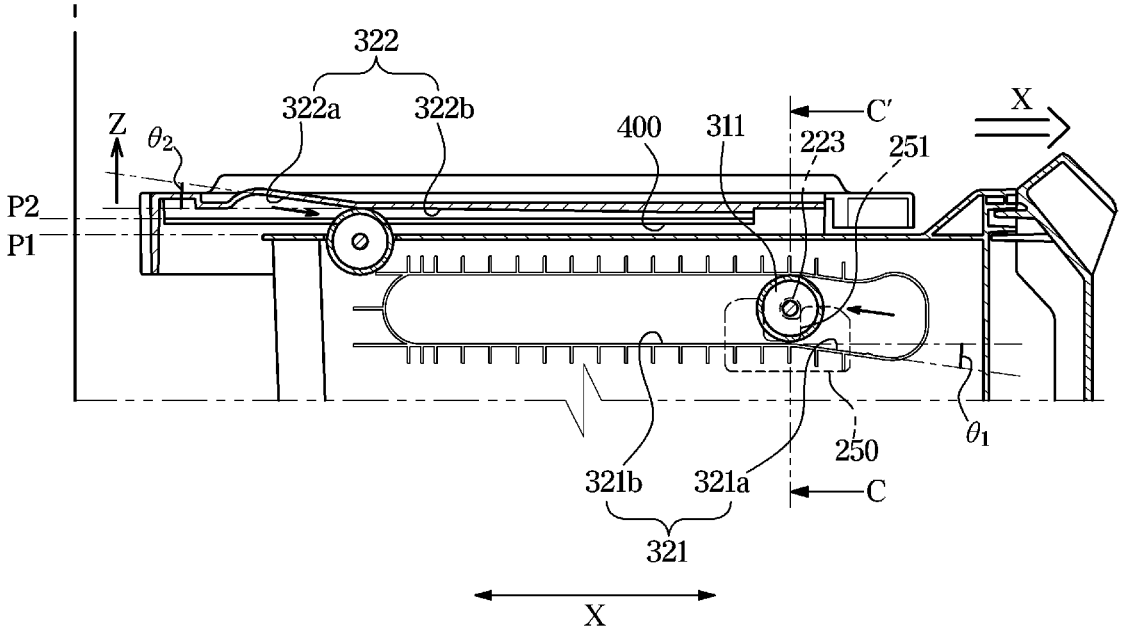
FIG. 12 illustrates operation of the rail device according to an embodiment of the disclosure.
Figure 13:
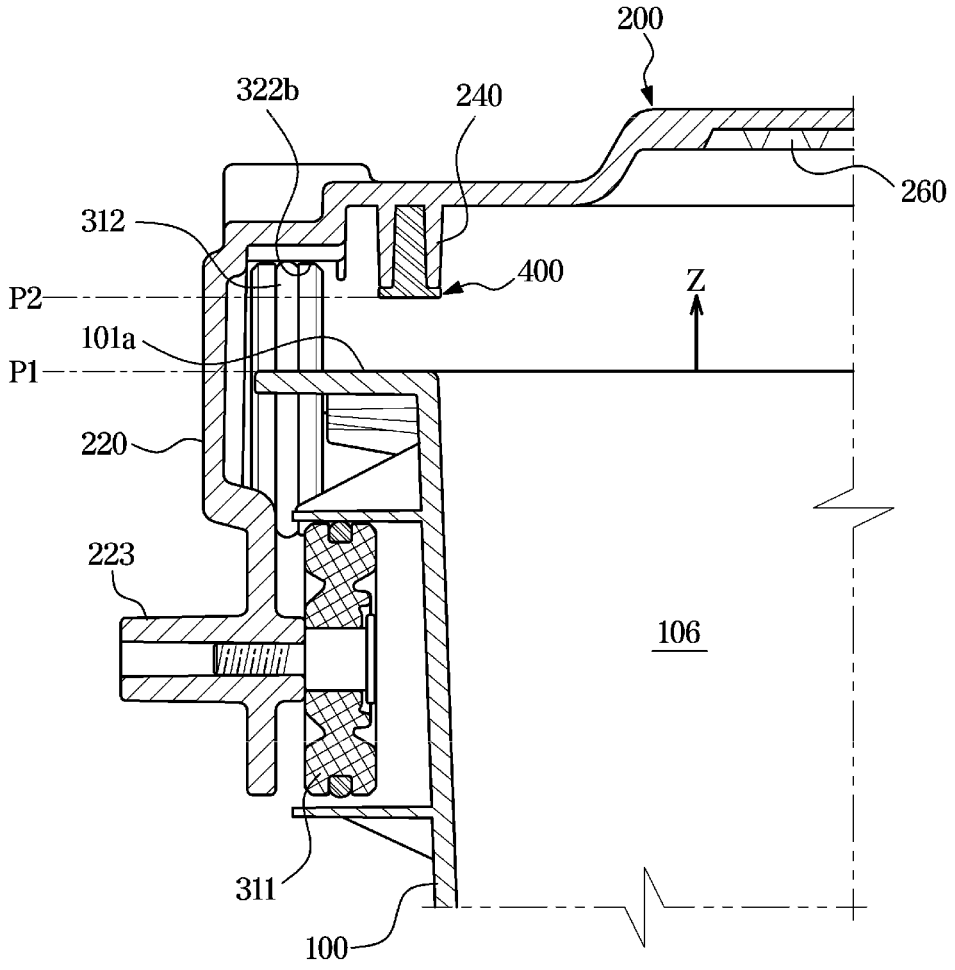
FIG. 13 is a cross-sectional view taken along line C-C' of FIG. 12, illustrating the state of the drawer and cover in a second position in which the drawer and cover are spaced apart from each other.

FIG. 10 illustrates a state before a rail device according to an embodiment of the disclosure operates, FIG. 11 is a cross-sectional view taken along line B-B' of FIG. 10, illustrating the state of the drawer and cover in a first position in which the drawer and cover are in close contact with each other, FIG. 12 illustrates operation of the rail device according to an embodiment of the disclosure, and FIG. 13 is a cross-sectional view taken along line C-C' of FIG. 12, illustrating the state of the drawer and cover in a second position in which the drawer and cover are spaced apart from each other.

As illustrated in FIGS. 10 to 13, the rail device 300 is configured to allow the cover 200 to move in the second direction Z as the drawer 100 moves in the first direction X.

That is, the rail device 300 is configured to allow the cover 200 to move upward in the second direction Z when the drawer 100 is withdrawn in the first direction X between the drawer 100 and the cover 200.

When the drawer 100 is accommodated in the storage chambers 20, 30, and 40, at least a portion of the cover 200 corresponds to a state of being in contact with the contact surface 101*a* of the drawer 100. The cover 200 may cover the storage space 106 of the drawer 100. The cover 200 is in a state of covering the open upper surface of the drawer 100 to cover the storage space 106 of the drawer 100. The cover 200 may seal the storage space 106 of the drawer 100.

In this case, the first roller 311 of the rail device 300 is positioned in the first section 321*a* of the first rail 321, and the second roller 312 is positioned in the third section 322*a* of the second rail 322. Further, at least one surface of the sealing member 400 disposed between the cover 200 and the drawer 100 comes into contact with the contact surface 101*a* of the drawer 100. The gap between the cover 200 and the drawer 100 may be sealed by the sealing member 400. The cover 200 is positioned at the first position P1 in which the cover 200 and the drawer 100 are in close contact with each other.

When the drawer 100 is withdrawn from the storage chambers 20, 30, and 40 and moved forward (first direction), the cover 200 corresponds to a state of opening the upper surface of the drawer 100. The cover 200 allows the storage space 106 of the drawer 100 to be opened. The drawer 100 is moved to the front of the cover 200.

When the drawer 100 is withdrawn and moved in the front (first direction) of the storage chambers 20, 30, and 40, the first roller 311 moves to the second section 321*b* of the first rail 321, and the second roller 312 moves to the fourth section 322*b* of the second rail 322. In other words, the first roller 311 and the second roller 312 move upward (second direction) to the same height as the height of the first inclination θ1 and the second inclination θ2 and are positioned at the second position P2 moved to be spaced upwardly from the drawer 100. The second position P2 may be a position spaced upward from the first position P1. The first roller 311 and the second roller 312 are moved along the second section 321*b* of the first rail 321 and the fourth section 322*b* of the second rail 322, respectively, by the drawer 100.

Because the cover 200 is spaced apart from the drawer 100 when the cover 200 is positioned at the second position P2, the storage space 106 of the drawer 100 becomes in an open state.

When the user pulls the handle 103 of the drawer 100 in the storage chamber 20, 30, and 40 forward in the first direction X, the drawer 100 is withdrawn from the storage chamber 20, 30, and 40.

In this case, the cover 200 is moved upwardly, that is, in the second direction Z by the first rail 321 and the second rail 322. Accordingly, the user may use the cover 200 without a separate opening operation. In addition, the drawer 100 is moved into the storage chambers 20, 30, and 40, and at the same time the cover 200 is moved downward, that is, in the second direction Z, so that the storage space 106 of the drawer 100 may be sealed.

By the movement of the drawer 100, the cover 200 moving from the first position P1 to the second position P2 may improve the usability of the drawer to improve the quality of the product.

As is apparent from the above, a refrigerator according to an embodiment of the disclosure can have an improved construction to maintain the humidity in a drawer and can improve water collecting performance by improving a water collecting pattern of a drawer cover.

Further, the refrigerator according to an embodiment of the disclosure can improve usability of the drawer by allowing the drawer to be used without a separate cover opening/closing manipulation.

While the disclosure has been particularly described with reference to exemplary embodiments, it should be understood by those of skilled in the art that various changes in form and details may be made without departing from the spirit and scope of the disclosure.

What is claimed is:

1. A refrigerator comprising:

a storage chamber;

a drawer configured to be inserted to or withdrawn from the storage chamber;

a cover configured to cover an upper part of the drawer;

a cover fixing protrusion protruded from the cover and configured to limit movement of the cover;

a cover support groove provided on the storage chamber and corresponding to the cover fixing protrusion so that the cover is seated and supported therein and does not move together with the drawer when the drawer moves in the front-rear direction, the cover support groove having an open upper side to allow the cover to move in an up-down direction; and a rail device configured to guide the drawer to move in a front-rear direction with respect to the cover and to allow the cover to be moved upward with respect to the drawer at an inside of the storage chamber when the drawer is withdrawn from the storage chamber, wherein the rail device comprises:

a first roller provided in a front of the cover;

a second roller provided in a rear of the drawer;

a first rail provided on opposite outer side surfaces of the drawer in the front-rear direction to support movement of the first roller; and a second rail provided on opposite inner side surfaces of the cover in the front-rear direction to support movement of the second roller, and wherein the cover is spaced apart from an upper side of the drawer in an upward direction when the drawer is withdrawn.

2. The refrigerator according to claim 1, wherein the first roller is rotatably disposed in a front of the storage chamber and configured to be movable in an up-down direction along the first rail.

3. The refrigerator according to claim 2, wherein the first rail comprises a first section having a first inclination and a second section extending in a horizontal direction from one end of the first section.

4. The refrigerator according to claim 3, wherein the second roller is rotatably disposed in the rear of the drawer and configured to be movable in the front-rear direction along the second rail.

5. The refrigerator according to claim 4, wherein the second rail is provided on a rear surface of the cover while extending in the front-rear direction of the storage chamber.

6. The refrigerator according to claim 5, wherein the second rail comprises a third section having a second inclination and a fourth section extending in the horizontal direction from one end of the third section.

7. The refrigerator according to claim 6, wherein the first inclination and the second inclination are identically formed.

8. The refrigerator according to claim 6, wherein a length of the first section is same as a length of the third section.

9. The refrigerator according to claim 6, wherein the rail device linearly moves the cover in the up-down direction in the first section and the third section.

10. The refrigerator according to claim 6, wherein the rail device maintains a position in which the cover is moved upward, in the second section and the fourth section.

11. The refrigerator according to claim 1, wherein a water collecting pattern configured to condense moisture is formed on one surface of the cover corresponding to the drawer.

12. The refrigerator according to claim 1, further comprising a sealing member provided between the drawer and the cover to seal the cover with the drawer.

13. A refrigerator comprising:

a storage chamber having an open front surface;

a drawer provided inside the storage chamber and configured to be inserted to or withdrawn from the storage chamber;

a cover to cover the drawer and having a water collecting pattern formed on at least portion thereof;

a cover fixing protrusion protruded from the cover and configured to limit movement of the cover;

a cover support groove provided on the storage chamber and corresponding to the cover fixing protrusion so that the cover is seated and supported therein and does not move together with the drawer when the drawer moves in the front-rear direction, the cover support groove having an open upper side to allow the cover to move in an up-down direction; and a rail device configured to movably connect the drawer and the cover, and guide the drawer to move in a first direction of the storage chamber with respect to the cover, wherein the cover is configured to move in a second direction perpendicular to the first direction with respect to the drawer from the storage chamber, wherein the rail device comprises:

a first roller provided in a front of the cover;

a second roller provided in a rear of the drawer;

a first rail provided on opposite outer side surfaces of the drawer in the front-rear direction to support movement of the first roller; and a second rail provided on opposite inner side surfaces of the cover in the front-rear direction to support movement of the second roller, and wherein the cover is spaced apart from an upper side of the drawer in an upward direction when the drawer is withdrawn.

14. The refrigerator according to claim 13, wherein the rail device is configured to allow the cover to move from a first position in which the cover covers the drawer to a second position higher than the first position when the drawer is withdrawn.

15. The refrigerator according to claim 14, wherein the first rail comprises a first section having a first inclination and a second section extending in a horizontal direction from the first section.

16. The refrigerator according to claim 15, wherein the second rail is provided on a rear surface of the cover to extend in the front-rear direction of the storage chamber and comprises a third section having a second inclination and a fourth section extending in the horizontal direction from the third section.

17. The refrigerator according to claim 16, wherein the first inclination and the second inclination are identically formed.

* * * * *